US008171666B2

(12) United States Patent
Karagias

(10) Patent No.: US 8,171,666 B2
(45) Date of Patent: May 8, 2012

(54) SCOPE MOUNTING CLAMPS FOR FIREARMS

(75) Inventor: Theodore Karagias, Seattle, WA (US)

(73) Assignee: Theodore Karagias, Seattle, WA (US)

( * ) Notice: Subject to any disclaimer, the term of this patent is extended or adjusted under 35 U.S.C. 154(b) by 295 days.

(21) Appl. No.: 12/510,973

(22) Filed: Jul. 28, 2009

(65) Prior Publication Data

US 2011/0023348 A1 Feb. 3, 2011

(51) Int. Cl.
*F41G 1/387* (2006.01)

(52) U.S. Cl. ..... 42/124; 42/127; 42/85

(58) Field of Classification Search ..... 42/85, 124, 42/125, 126, 127
See application file for complete search history.

(56) References Cited

U.S. PATENT DOCUMENTS

| | | | | | |
|---|---|---|---|---|---|
| 2,018,960 | A * | 10/1935 | Kuhn | 42/126 |
| 2,425,130 | A * | 8/1947 | Lewis | 42/16 |
| 2,493,254 | A * | 1/1950 | Leupold | 42/126 |
| 2,510,289 | A * | 6/1950 | Livermore | 42/125 |
| 2,545,419 | A * | 3/1951 | Williams | 42/127 |
| 2,597,466 | A * | 5/1952 | Felix | 42/127 |
| 2,717,447 | A * | 9/1955 | Leupold | 42/127 |
| 2,743,525 | A * | 5/1956 | Leupold | 42/126 |
| 2,782,511 | A * | 2/1957 | Ivy | 42/126 |
| 2,803,880 | A * | 8/1957 | Weaver | 42/128 |
| 2,803,907 | A * | 8/1957 | Weaver | 42/124 |
| 2,857,675 | A * | 10/1958 | Kesselring | 42/127 |
| 2,937,448 | A * | 5/1960 | Dimick | 42/126 |
| 3,253,361 | A * | 5/1966 | Kingsbury | 42/124 |
| 3,295,811 | A * | 1/1967 | Giwosky | 248/229.11 |
| 3,401,460 | A * | 9/1968 | Tellie | 42/124 |
| 3,463,430 | A * | 8/1969 | Jimenez et al. | 42/124 |
| 3,579,840 | A * | 5/1971 | Heinzel | 42/127 |
| 3,877,166 | A * | 4/1975 | Ward | 42/127 |
| 3,880,389 | A * | 4/1975 | Burris | 248/205.1 |
| 4,574,508 | A * | 3/1986 | Ross | 42/124 |
| 4,688,345 | A * | 8/1987 | Kilgour | 42/127 |
| 5,155,915 | A * | 10/1992 | Repa | 42/127 |
| 5,433,010 | A * | 7/1995 | Bell | 42/126 |
| 5,680,725 | A * | 10/1997 | Bell | 42/127 |
| 5,787,630 | A * | 8/1998 | Martel | 42/125 |
| 6,026,580 | A * | 2/2000 | LaRue | 42/127 |
| 6,705,037 | B2 * | 3/2004 | Van Kirk | 42/126 |
| 6,722,074 | B1 * | 4/2004 | Farrell | 42/124 |
| 7,272,904 | B2 * | 9/2007 | Larue | 42/127 |
| 7,562,484 | B2 * | 7/2009 | Kim | 42/114 |
| 7,677,755 | B2 * | 3/2010 | Kim | 362/190 |
| 7,730,655 | B2 * | 6/2010 | Spuhr | 42/127 |
| 7,814,697 | B2 * | 10/2010 | Esch | 42/85 |
| 2003/0192224 | A1 * | 10/2003 | Kirk | 42/124 |

(Continued)

OTHER PUBLICATIONS

Catalog Page, "Conetrol Scope Mounts" downloaded from http://www.conetrol.com/ on Jul. 21, 2009, 3 pages.

*Primary Examiner* — Benjamin P Lee
(74) *Attorney, Agent, or Firm* — Perkins Coie LLP

(57) ABSTRACT

A sighting assembly for a firearm includes a scope and a mounting clamp. The mounting clamp includes a ring cap and a ring base that cooperate to surround and hold the scope. The ring cap and ring base securely grip the scope without damaging the scope. Clamping forces are generally tangent to the scope to minimize or limit the formation of dents, grooves, or other types of marring and/or damage to optics or the body of the scope.

15 Claims, 11 Drawing Sheets

U.S. PATENT DOCUMENTS

2004/0148842 A1* 8/2004 Aalto et al. ..... 42/127
2006/0010758 A1* 1/2006 Zeh ..... 42/124
2006/0123686 A1* 6/2006 Larue ..... 42/127
2007/0266612 A1* 11/2007 Kim ..... 42/127
2008/0022576 A1* 1/2008 Epling ..... 42/124
2008/0034638 A1* 2/2008 Spuhr ..... 42/127
2009/0133311 A1* 5/2009 Hollenbach et al. ..... 42/124
2009/0288325 A1* 11/2009 Esch ..... 42/85

* cited by examiner

SCOPE MOUNTING CLAMPS FOR FIREARMS

BACKGROUND

1. Technical Field

The present invention relates generally to sighting assemblies for firearms. More specifically, the invention relates to mounting clamps capable of coupling a telescope sight to a firearm.

2. Description of the Related Art

Telescopic sights are used in a wide range of different fields. Telescopic sights, such as scopes, are often used to aim firearms, such as rifles or handguns. A user can peer through the scope to view a target up close. Conventional multi-piece rings for mounting scopes often include an upper member and a lower member that can be joined together to surround the scope. Unfortunately, scopes are often damaged due to high stresses produced as the upper and lower members are fastened together. Loads can be transmitted through sharp corners of the upper and lower members producing stress concentrations in the scope. The stress concentrations may result in unsightly damage and an unfavorable overall appearance of the scope. If the scope is deformed by a significant amount, optical components within the scope may become misaligned or damaged.

BRIEF SUMMARY

At least some embodiments disclosed herein are directed to a sighting assembly with at least one mounting clamp configured to grip a telescopic sight without creating appreciable localized stresses in the sight so as to avoid or limit damage to the sight. A closing device pulls the mounting clamp closed using tangential loading. In certain embodiments, the mounting clamp is in the form of a non-marring tangential clamp that can produce relatively high clamping forces without marring the outer surface of the sight.

In some embodiments, a mounting clamp is configured to provide tangential clamping to minimize, limit, or substantially eliminate stresses imparted upon a telescopic sight. The closed mounting clamp contacts an entire circumference of a generally tubular section of the telescopic sight. In certain embodiments, the mounting clamp includes a ring cap and a ring base that at least partially overlap to completely encircle the tubular section to provide about 360 degrees of contact. In certain embodiments, the ring cap mates with the ring base.

The clamping device, in some embodiments, includes one or more fasteners positioned to tighten the mounting clamp without imparting a substantial moment upon the ring cap or the ring base, or both, that would be resolved through a small area of the outer surface of the telescopic sight. In certain embodiments, a pair of fasteners of the clamping device imparts closing forces along respective lines of action oriented and positioned to substantially prevent moments that would result in the ring cap and/or ring base damaging the telescopic sight.

In some embodiments, a scope mounting clamp includes a ring base, a ring cap, and a fastener. The ring base includes a member that mates with corresponding mating members of the ring cap when the ring cap is in a closed position. In particular embodiments, the member of the ring base is an elongate protrusion having a curved surface to accommodate a scope. The mating members of the ring cap can be in the form of legs. Each of the legs has an internally threaded hole for receiving a fastener.

In some embodiments, a scope mounting clamp is coupleable to a firearm. The scope mounting clamp includes a ring cap, a ring base, and a fastener. The ring base is configured to cooperate with the ring cap to define an opening for receiving a scope. The fastener is connectable to both the ring cap and the ring base. In certain embodiments, the fastener is configured to provide a closing force along a line of action that is substantially tangent to the opening when the scope mounting clamp is in a closed configuration.

The fastener, in some embodiments, is positioned on one side of an imaginary plane lying upon a longitudinal axis of the opening. The imaginary plane is substantially perpendicular to the line of action or other force. In some embodiments, the imaginary plane is generally horizontal (e.g., generally perpendicular to a vertical center plane of the firearm). In other embodiments, the imaginary plane is at other orientations.

In some embodiments, a scope mounting clamp comprises a first part, a second part, and a fastener. The second part is movable from an open position to a closed position and includes a first end, a second end, and a main body. The main body extends between the first end and the second end to form a contact surface. The fastener is configured to engage a portion of the first part and to extend at least partially through the first end such that the fastener provides a force that is along a line of action that is substantially tangent to the curved contact surface when the fastener is tightened.

The fastener physically contacts, threadably engages, or otherwise engages at least a portion of the first part and/or second part. In certain embodiments, the fastener is used to push the first part away from the second part. In other embodiments, the fastener is used to bring the first and second parts together.

The first part can be an arcuate ring base. The second part can be an arcuate ring cap that cooperates with the ring base to form a substantially circular opening. The ring cap and ring base can cooperate to provide a high level of contact with the scope to minimize, limit, or substantially eliminate damage to the scope.

In other embodiments, a mounting clamp for a firearm comprises a first part, a second part, and at least one elongate fastener. At least a portion of the first part and at least a portion of the second part cooperate to form an opening. The opening is dimensioned and configured to receive the scope. In certain embodiments, the elongate fastener is positioned to engage at least one of the first part and the second part to provide a force along the line of action to tighten the scope mounting clamp. The elongate fastener is spaced apart from an imaginary plane that extends along, i.e., lying upon, a longitudinal axis of the opening and that is substantially perpendicular to the line of action. In certain embodiments, the elongate fastener is in the form of a screw that is spaced apart from the imaginary plane in a substantially horizontal orientation.

In some embodiments, a mounting clamp includes a ring assembly and a closing device. The ring assembly is mountable to a firearm and includes a first component and a second component. The closing device is configured to move the first component towards the second component while maintaining a distance of separation between diametrically opposed portions of at least one of the first component and the second component. In certain embodiments, the first component is in the form of a ring cap, and the second component is in the form of a ring base.

In some embodiments, a scope mounting clamp comprises means for holding a scope. The means for holding the scope is movable from an open position to a closed position such that a force is produced along a line of action that is substantially tangent scope when the means for holding the scope is tightened. The means for holding the scope can include one or more fasteners.

BRIEF DESCRIPTION OF THE SEVERAL VIEWS OF THE DRAWINGS

Non-limiting and non-exhaustive embodiments are described with reference to the following drawings. The same reference numerals refer to like parts or acts throughout the various views, unless otherwise specified.

DETAILED DESCRIPTION

Figure 1:
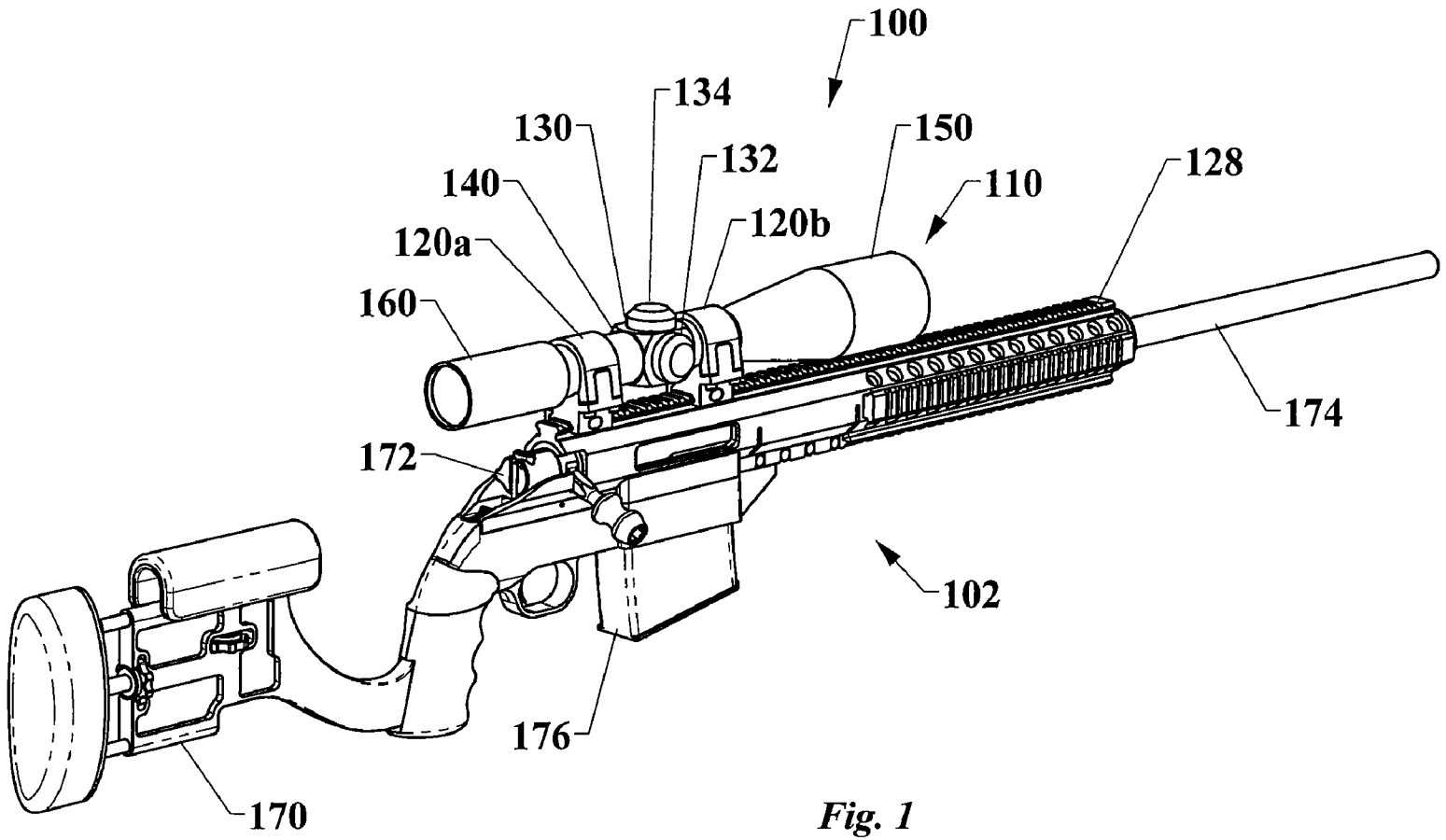
FIG. 1 is an isometric view of a firearm and a viewing assembly coupled to the firearm, in accordance with one embodiment.

FIG. 1 shows a viewing assembly 100 mounted on a firearm 102. The viewing assembly 100 includes a sight 110 and a pair of mounting clamps 120*a*, 120*b* (collectively "120"). Relatively large clamping forces can be achieved without damaging (e.g., marring, denting, bending, scratching, or otherwise permanently deforming) a tubular section 140 of the sight 110. The mounting clamps 120 can provide primarily tangential loading to manage stress concentrations, if any, in the tubular section 140.

Figure 2:
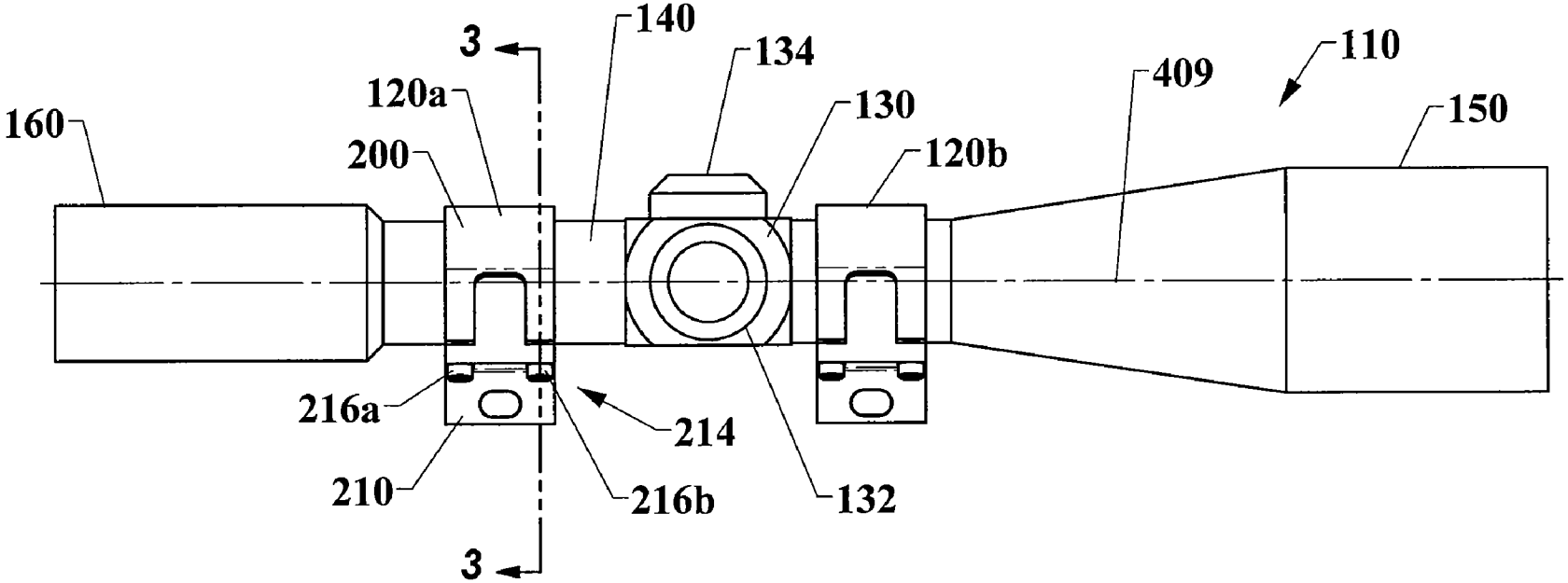
FIG. 2 is a side elevational view of the viewing assembly of FIG. 1.

The sight 110 can be a telescopic sight or other aiming device. Sights can include optical components, such as optical trains, objective lenses, ocular lenses, reticles, and other lenses that cooperate to provide desired viewing functionality. The sight 110 of FIGS. 1 and 2 is a scope that includes a windage and elevation adjustment mechanism 130. A user may rotate dials 132, 134 to establish the desired windage or elevation setting. The illustrated adjustment mechanism 130 is positioned between the mounting clamps 120*a*, 120*b*. The scope 110 may also include other types of controls or adjustment mechanisms.

The scope 110 also includes an objective 150, an eyepiece 160, and the tubular section 140 extending between the objective 150 and the eyepiece 160. The objective 150 carries objective lenses, and the eyepiece 160 carries ocular lenses. Imaging optics (e.g., an erector assembly, zoom assembly, reticle, combinations thereof, or the like) can be within and protected by the tubular section 140. Light can propagate through the imaging optics to provide an image to the observer.

Referring again to FIG. 1, the firearm 102 is a rifle with a butt stock 170, a firing mechanism 172, and a barrel 174. The firing mechanism 172 receives ammunition from a magazine 176. The mounting clamps 120 are coupled to a mounting rail 128. To move the scope 110, the mounting clamps 120 can release the mounting rail 128 and be coupled at appropriate locations along the rail 128. In other embodiments, the viewing assembly 100 is coupled to other types of firearms, such as a handgun (e.g., a pistol, a revolver, etc.), an airgun, or other types of devices used to shoot projectiles, such as a crossbow.

Figure 3:
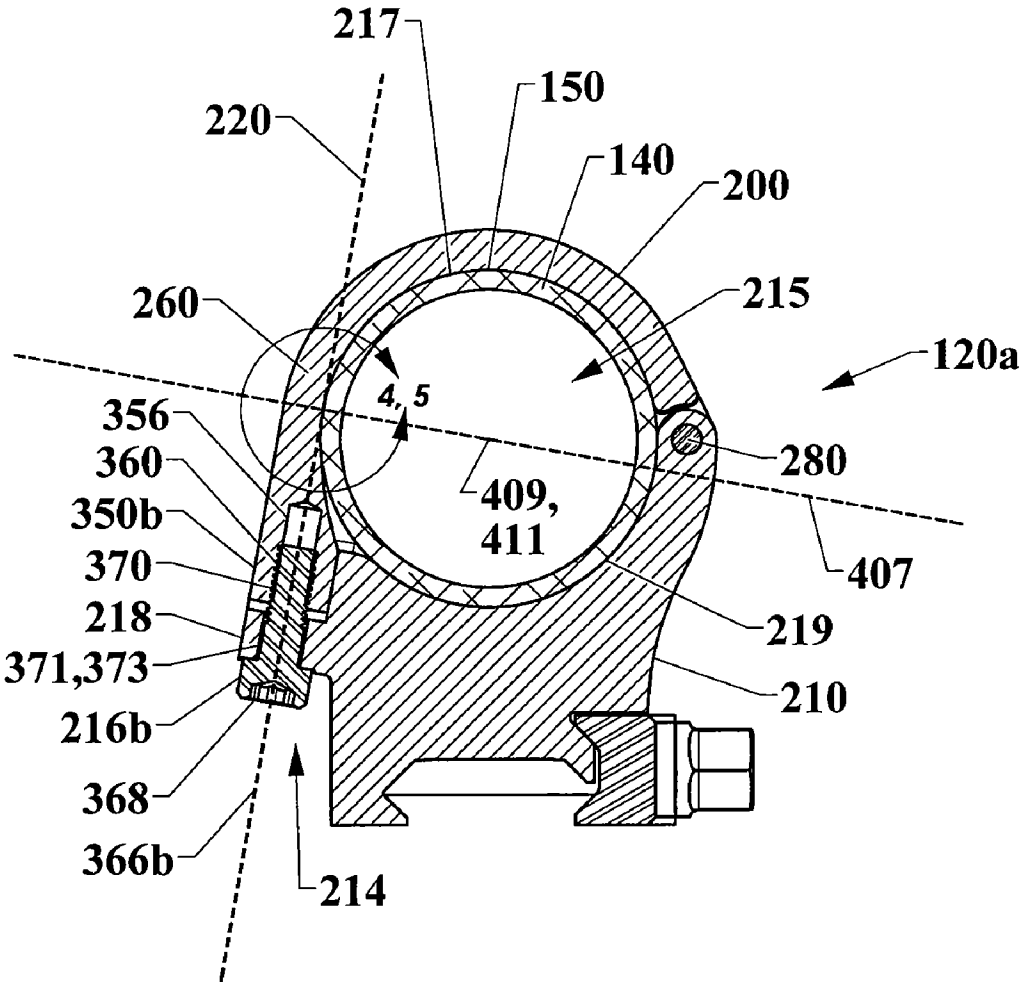
FIG. 3 is a cross-sectional view of the viewing assembly taken along a line 3-3 of FIG. 2.

The mounting clamps 120*a*, 120*b* can be generally similar to each other. The following description of one of the mounting clamps applies equally to the other, unless indicated otherwise. FIGS. 2 and 3 show the mounting clamp 120*a* including a ring base 210, a ring cap 200 rotatably coupled to the ring base 210, and a closing device 214. The ring cap 200 and the ring base 210 cooperate to define an opening 215 and cooperate to substantially surround the entire tubular section 140. A curved inner surface 217 of the ring cap 200 can surround and contact about half of the circumference of the tubular section 140, while a curved inner surface 219 of the ring base 210 can surround and contact the other half of the circumference of the tubular section 140. The ring cap 200 and ring base 210 can thus provide about 360 degrees of contact. In some embodiments, the ring cap 200 and ring base 210 surround more or less than half of the circumference of the tubular section 140. For example, the ring cap 200 can surround more than half of the circumference of the tubular section 140, and the ring base 210 can surround less than half of the circumference of the tubular section 140.

The closing device 214 includes a pair of fasteners 216*a*, 216*b* (collectively "216") extending upwardly through the ring base 210 and into the ring cap 200. The fasteners 216 can be rotated to increase or decrease the clamping forces applied to the tubular section 140. The illustrated fasteners 216 can pull the ring cap 200 and ring base 210 against the tubular section 140 without causing radially inward displacement of the inner periphery of the mounting clamp 120 that would result in damage to the tubular section 140. The fasteners 216*a*, 216*b* can be generally similar to each other, and accordingly, the following description of one of the fasteners applies equally to the other, unless indicated otherwise.

Referring to FIG. 3, the fastener 216*b* extends through a boss 218 and partially through the ring cap 200. The orientation and position of the fastener 216*b* can be selected to minimize, limit, or substantially eliminate localized deformation of the surfaces 217, 219 that would result in stress concentrations along the surface 150. The fastener 216*b* can thus provide relatively high clamping forces while producing less scope damage, if any, than conventional mounting rings with edges that deform inwardly. For example, the fastener 216*b* of FIG. 3 can be positioned to eliminate adverse loading and unnecessary moments that could cause radially inward bending of the ring cap 200 and/or ring base 210. The surfaces 217, 219 can be substantially free of any geometric irregularities attributable to the clamping forces, even if high clamping forces are achieved.

Figure 4:
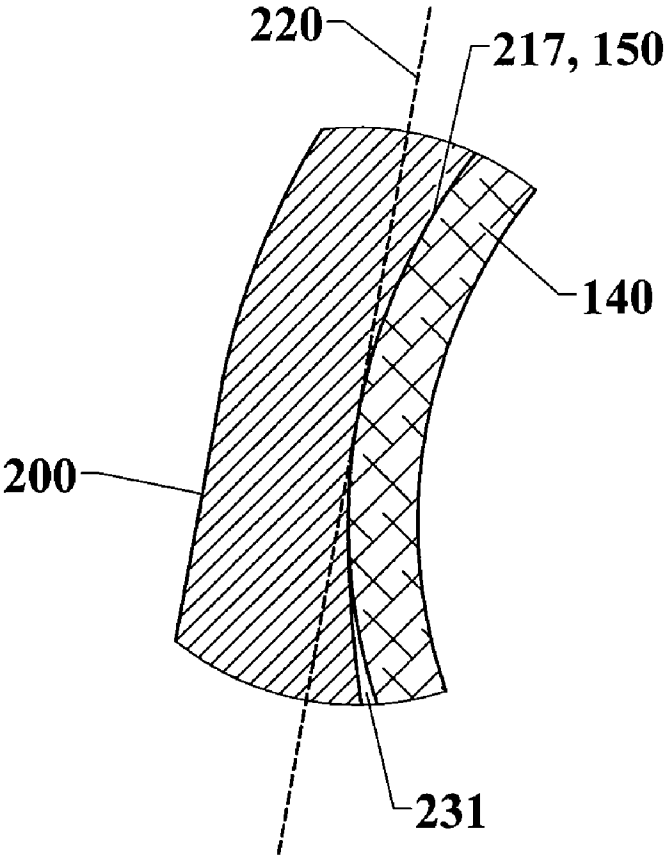
FIG. 4 is a detailed cross-sectional view of the viewing assembly of FIG. 3, in accordance with one embodiment.
Figure 5:
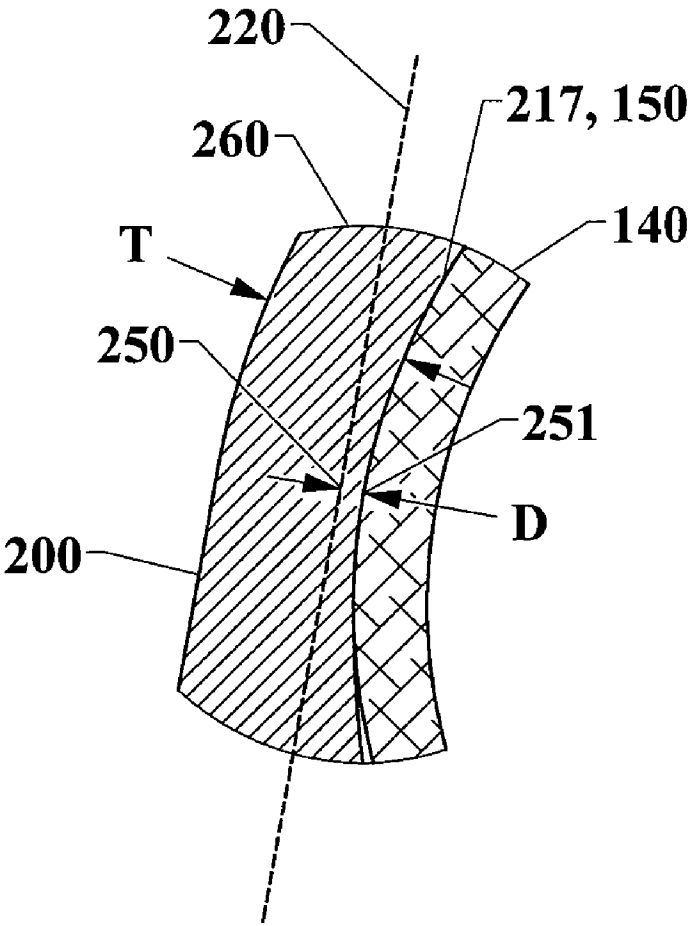
FIG. 5 is another detailed cross-sectional view of the viewing assembly of FIG. 3, in accordance with another embodiment.

To tighten the mounting clamp 120*a*, the fasteners 216 can be rotated. The fasteners 216 threadably engage the ring cap 200 and are retained by the ring base 210 such that, when the fasteners 216 are rotated, the ring cap 200 is pulled towards the ring base 210. FIG. 3 shows the fastener 216*b* capable of imparting an axial force along a line of action 220 proximate to the opening 215. In some embodiments, including the illustrated embodiment of FIG. 3, the line of action 220 is generally tangent to the surface 150 of the tubular section 140 such that the mounting clamp 120*a* does not mar surface 150, even if the surface 150 is made of a relatively soft metal (for example, aluminum). As shown in FIGS. 4 and 5, the ring cap 200 can have a curvature that is generally similar to the curvature of the outer surface 150. Other closing forces are also possible, if needed or desired. The surface 217 can gradually extend away from the surface 150 to form a narrow gap 231.

FIGS. 4 and 5 show the line of action 220 proximate to the surfaces 150, 217. FIG. 4 shows the line of action 220 generally tangent to the surface 150 of the tubular section 140. This prevents any appreciable moments that would cause deformation of the mounting clamp 120*a* sufficient to result in damage the scope 110 due to localized stresses. The line of action 220 may be slightly offset from a particular reference feature, such as the opening 215. FIG. 5 shows the line of action 220 spaced apart a minimum distance D from the surfaces 217, 150. The minimum distance D can be measured between a point 250 along the line of action 220 nearest the surface 150 and a point 251 along the surface 150 nearest the line of action 220. The minimum distance D can be reduced to reduce measurable deformation, if any, of the ring cap 200 or ring base 210, or both. In some embodiments, for example, the distance D can be less than a thickness T of a sidewall 260 of the ring cap 200. In some embodiments, the minimum distance D is less than about 50% of a major diameter of a threaded section 370 of the fastener 216*b* (see FIG. 3). The threaded section 370 can be adjacent to the surface 150 of the tubular section 140 to reduce the thickness of the portion of the sidewall 260 through which the fastener 216*b* extends. In some embodiments, the minimum distance D is in a range of about 30% to about 50% of the major diameter of the threaded section 370. Such embodiments enable the use of top mounted fasteners. For example, mounting clamps can be configured to receive fasteners inserted downwardly through a ring cap and a flexible ring base, respectively. The flexible ring base can deform to surround more than half of the circumference of the scope. In some embodiments, the minimum distance D is less than about 25% of the major diameter of the threaded section 370. Such minimum distances are especially well suited for use with generally rigid ring bases. In some embodiments, the distance D is less than or equal to about 0.1 inch, 0.05 inch, 0.02 inch, 0.01 inch, or ranges encompassing such distances. The distance D can be kept at or below a limit distance that is selected based on, for example, proper load paths, manufacturing tolerances of the scope 110, properties of the tubular section 140 (e.g., ultimate yield strength, hardness, or the like), desired clamping forces, or the like.

As shown in FIG. 3, the fastener 216*b* can be sheltered to avoid snagging on brush, clothing, or the like and/or to provide an aesthetically pleasing appearance. A head 368 of the fastener 216*b* can face the firearm 102 such that, when a user manually grasps the firearm 102, the head 368 does not impinge upon the user's hand causing discomfort. As such, the firearm 102 can be comfortably and conveniently transported. The positions and orientations of the fasteners 216 can be selected based on the configuration and dimensions of the firearm.

Figure 6:
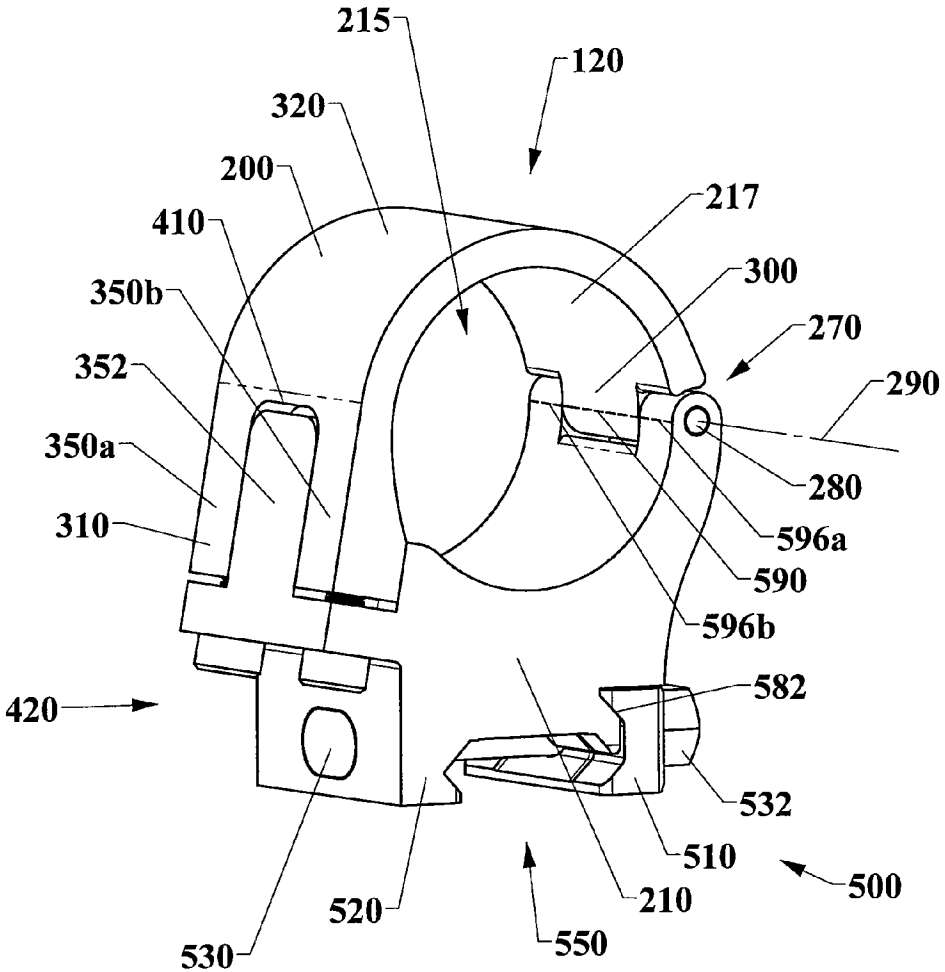
FIG. 6 is an isometric view of a mounting clamp, in accordance with one embodiment.
Figure 7:
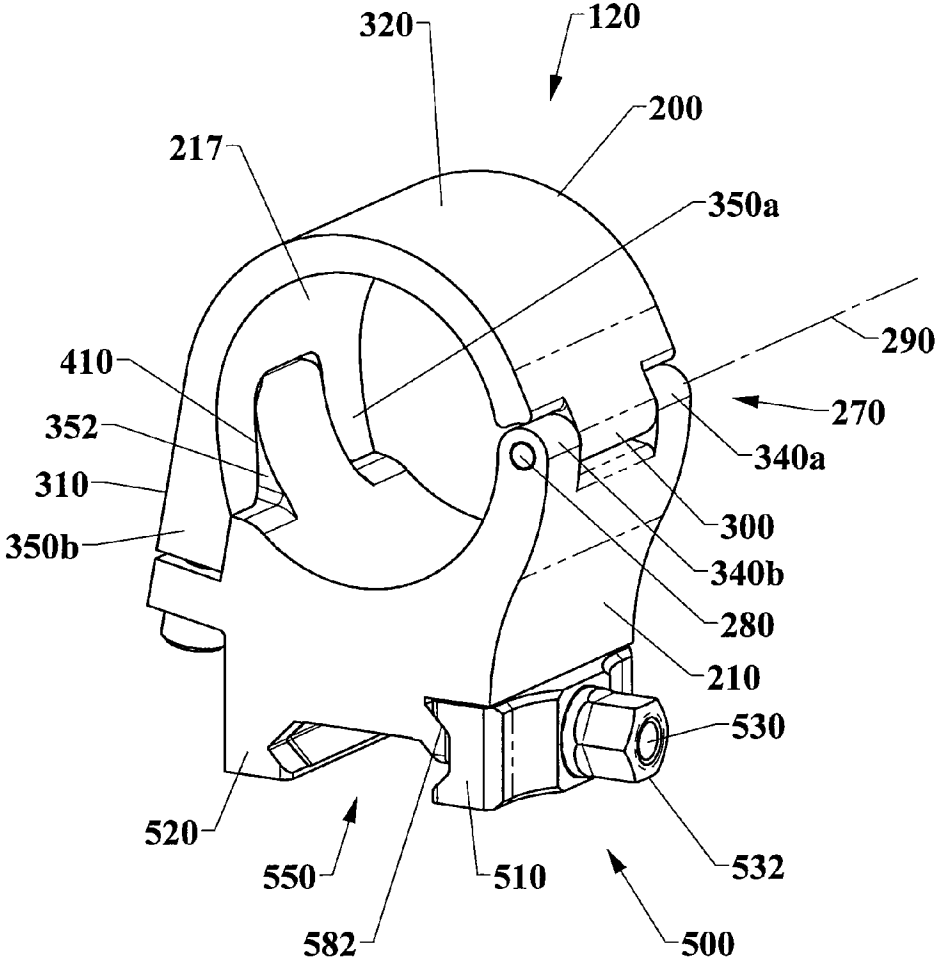
FIG. 7 is another isometric view of the mounting clamp of FIG. 6.
Figure 8:
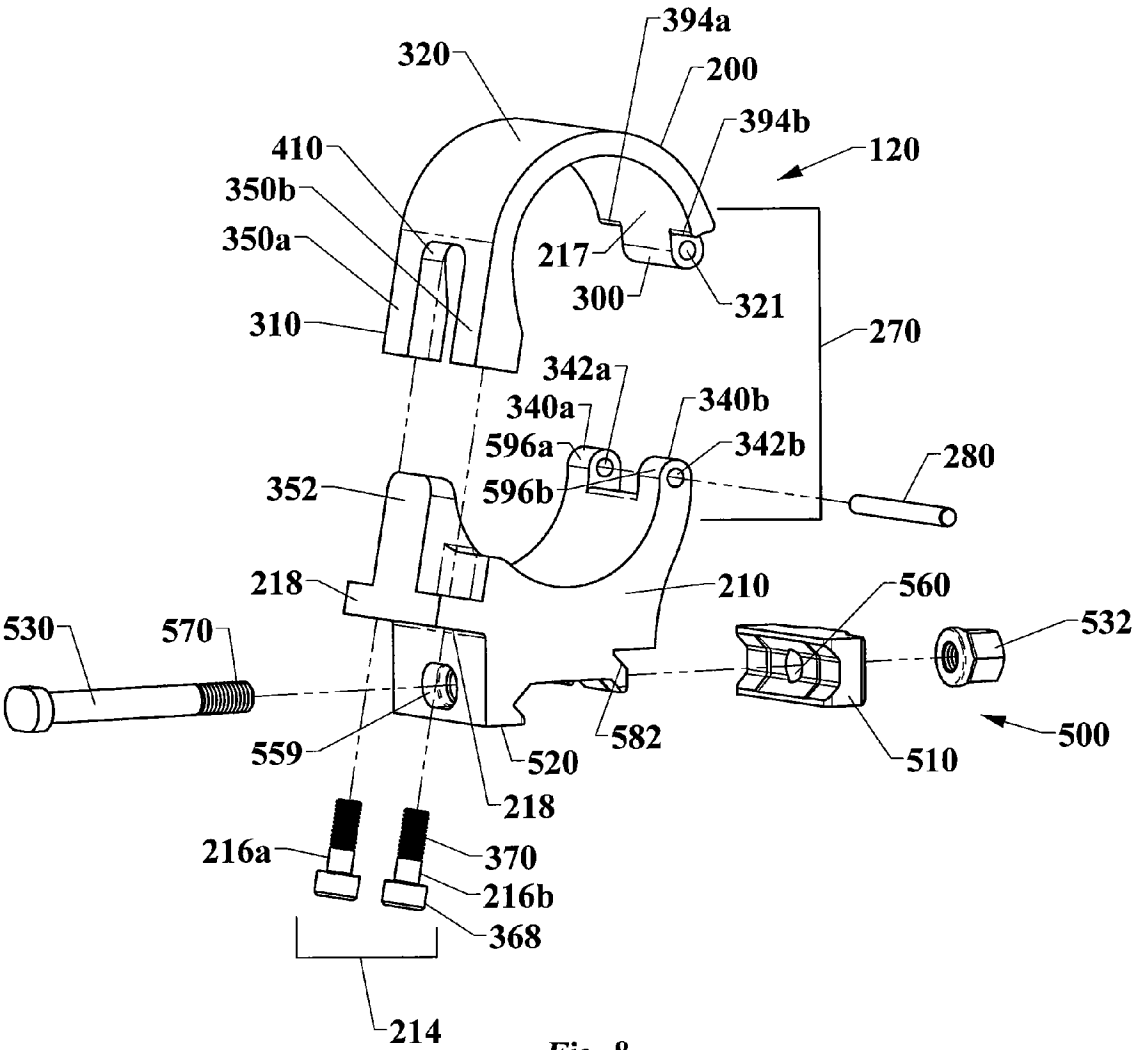
FIG. 8 is an exploded isometric view of the mounting clamp of FIG. 6.

FIGS. 6-8 show a hinge 270 formed by the ring clamp 200, the ring base 210, and a pin 280 extending through both the ring cap 200 and the ring base 210. The ring cap 200 is rotatable about an axis of rotation 290 between an open position and a closed position. Other types of connections with moving components, flexible components, or the like can also couple the ring cap 200 to the ring base 210. In some embodiments, a separate hinge assembly or a flexible element can couple the ring cap 200 to the ring base 210.

Referring to FIGS. 7 and 8, the ring cap 200 includes a hinge end 300, a mating end 310, and an arcuate main body 320 extending therebetween. The hinge end 300 has a through-hole 321 for receiving the pin 280. To assemble the ring cap 200 and the ring base 210, the hinge end 300 can be inserted between mounts 340*a*, 340*b*. The pin 280 can be inserted through through-holes 342*a*, 342*b* of the respective mounts 340*a*, 340*b* and the through-hole 321.

The arcuate main body 320 extends between the ends 300, 310. The main body 320 and ends 300, 310 form the inner surface 217 with a complementary shape to the outer surface 150 of the tubular section 140. The illustrated main body 320 has a generally semi-circular shape. Other shapes are also possible, if needed or desired.

The mating end 310 includes a pair of legs 350*a*, 350*b* (collectively "350"). The legs 350*a*, 350*b* can be generally similar to each other, and accordingly, the following description of one of the legs applies equally to the other, unless indicated otherwise. The legs 350*a*, 350*b* are spaced apart to receive an upwardly extending protrusion 352 of the ring base 210.

In some embodiments, including the illustrated embodiment of FIG. 3, the leg 350*b* has a hole 356 with internal threads 360 configured to threadably engage an external threaded section 370 of the fastener 216*b*. To move the leg 350*b* away from or towards the boss 218, the fastener 216*b* can be rotated about its longitudinal axis 366*b*. The illustrated longitudinal axis 366*b* of FIG. 3 is generally aligned (e.g., collinear) with the line of action 220. When assembled, the boss 218 is between the head 368 of the fastener 216*b* and the leg 350*b*. The configuration of the head 368 can be selected based on the desired installation tools. For example, the head 368 can be a hex head, socket head, slotted head, or the like. The fastener 216*b* may also include a shank 371 within a through-hole 373 in the boss 218.

Referring to FIG. 3, the fasteners 216 can be positioned on one side of an imaginary plane 407 that is positioned along a longitudinal axis 409 (see FIGS. 2 and 3) of the scope 110. The illustrated plane 407 is generally perpendicular to the line of action 220 and lays upon the longitudinal axis 409. As shown in FIG. 3, the end of the fastener 216*b* is spaced well apart from the imaginary plane 407. The illustrated imaginary plane 407 lays upon the longitudinal axis 409 of the scope 110, the illustrated imaginary plane 407 also extends through a longitudinal axis 411 of the opening 215. The fastener 216*b* can thus apply a force along a line of action that is relatively close to the scope 110. In some embodiments, the minimum distance between the line of action 220 and the opening 215 is equal to or less than half the major diameter of the threaded section 370 of the fastener 216*b*. The imaginary plane 407 can also be generally perpendicular to a longitudinal axis 366*b* of the fastener 216*b*.

Referring to FIGS. 6-8, a slot 410 can receive the protrusion 352 to provide a relatively large amount of circumferential contact. The illustrated protrusion 352 overlaps the legs 350 when the mounting clamp 120 is closed. When closed, the protrusion 352 and legs 350 can form a clearance fit, or other type of fit known in the art.

A clamp mechanism 500 includes a clamp member 510, a fixed portion 520 integrally formed with the ring base 210, a fastener 530, and a nut 532. The nut 532 is used to move the clamp member 510 towards the fixed portion 520 to adjust a width of a receiving channel 550. To assemble the clamp 500, the fastener 530 can be inserted through a through-hole 559 (see FIG. 8) in the fixed portion 520 and a through-hole 560 (see FIG. 8) in the clamp member 510. A threaded portion 570 of the fastener 530 can protrude outwardly from the clamp member 510. The nut 532 can be torqued down over the threaded portion 570 to move the clamp member 510 into a receiving section 582 of the ring base 210.

To couple the mounting clamp 120 to the firearm 102 of FIG. 1, the mounting rail 128 can be inserted into the channel 550. The clamp member 510 can be moved towards the fixed portion 520 to grip the mounting rail 128 so as to fixedly couple the mounting clamp 120 to the firearm 102. The mounting rail 128 can be an accessory rail or other type of rail to which components can be mounted.

The ring base 210 can have other types of mechanisms (e.g., clamps, brackets, pins, screws, fastener assemblies, etc.) for coupling to other types of mounting features (e.g., rails, brackets, pin holes, screw holes, or the like) or to other components (e.g., a receiver, barrel, or the like) of a firearm. The design of the mechanism can be selected based on the design of the firearm. The ring base 210 can be incorporated into the firearm 102. For example, the ring base 210 can be monolithically formed (e.g., via an injection molding process, machining processes, or the like) with a receiver or other component of the firearm 102.

Figure 9:
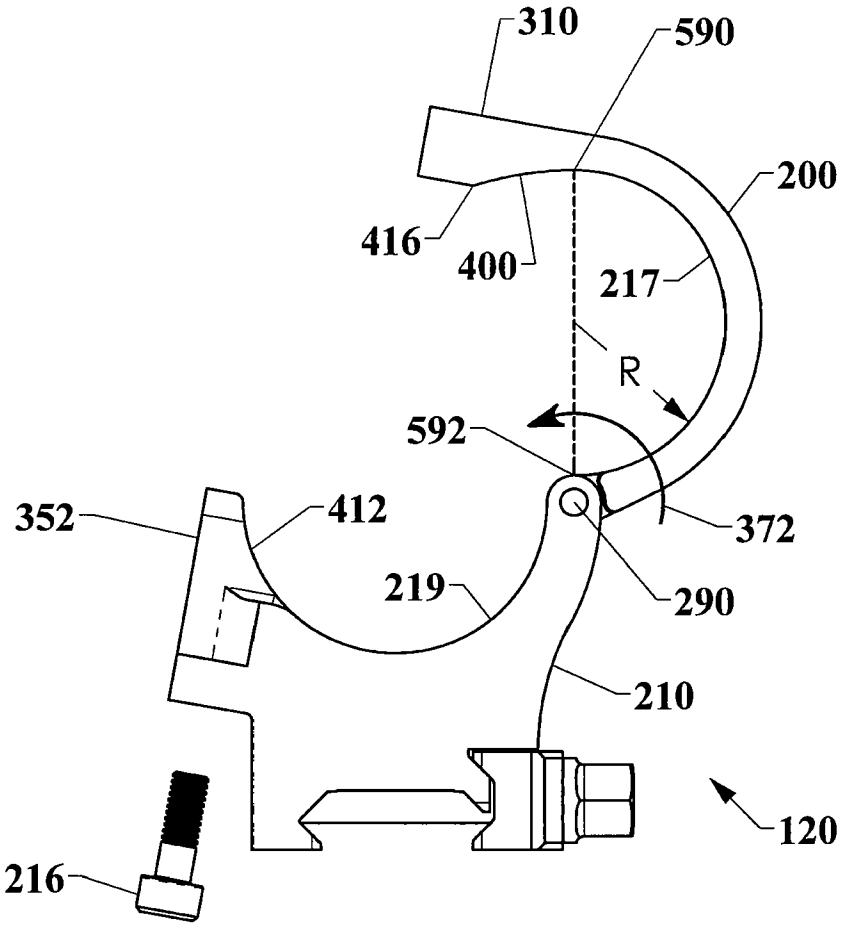
FIG. 9 is a front elevational view of a mounting clamp in an open configuration. A fastener is ready to be installed.

FIG. 9 shows the ring cap 200 in an open position. The scope 110 can be placed upon the surface 219 of the ring base 210. After the scope 110 is brought to rest on the surface 219, the ring cap 200 can be rotated counter-clockwise about the axis of rotation 290 (indicated by an arrow 372) to the closed position shown in FIG. 10. The fasteners 216 are inserted into the respective holes in the legs 350. The fasteners 216 are rotated until a desired fit with the scope is achieved.

The fastener 216 can pull the ring cap 200 towards the ring base 210 while substantially maintaining a distance between diametrically opposed inner portions 590, 592 of the ring cap 200. When the mounting clamp 120 is tightened, a reduction in distance, if any, between the diametrically opposed inner portions 590, 592 can be sufficiently small to prevent damage to the tubular section 140. The radius R (see FIG. 10) of curvature can be kept generally constant as the fasteners 216 are tightened. High clamping forces can be achieved while maintaining the radius R to avoid significant stresses in the tubular section 140. As shown in FIG. 5, the curvatures of the surface 217 and surface 150 can be generally uniform.

The length of the inner portion of the ring cap 200 defining a portion of the opening 215 can be about 60%, 55%, 50%, 45%, 40%, or 35% A of the circumference of the opening 215 to provide a relatively large contact surface 217. If the ring cap 200 defines more than 50% of the circumference of the opening 215, the ring cap 200 can be made, in whole or in part, of a compliant material and can wrap around the tubular section 140. If the ring cap 200 defines less than 50% of the circumference of the opening 215, the ring base 210 can be made, in whole or in part, of a compliant material to allow insertion of the tubular section 140 into the ring base 210.

Compliant materials include, but are not limited to, plastics, polymers, rubbers, composites, combinations thereof, or the like. In some embodiments, the ring cap 200 and/or ring base 210 are made of engineering plastics, such as acrylonitrile butadiene styrene (ABS), polycarbonate resins, or other types of resilient plastics. Reinforcing elements (e.g., fibers, strands, etc.) can be used to limit or substantially prevent elongation. For example, the ring cap 200 can be made of a carbon fiber reinforced composite The ring cap 200 and/or ring base 210 can also be made, in whole or in part, of one or more rigid materials, such as rigid plastics or metals. Exemplary metals include, but are not limited to, steel (e.g., stainless steel), aluminum, titanium, or other type of alloys capable of achieving desired clamping forces.

Figure 10:
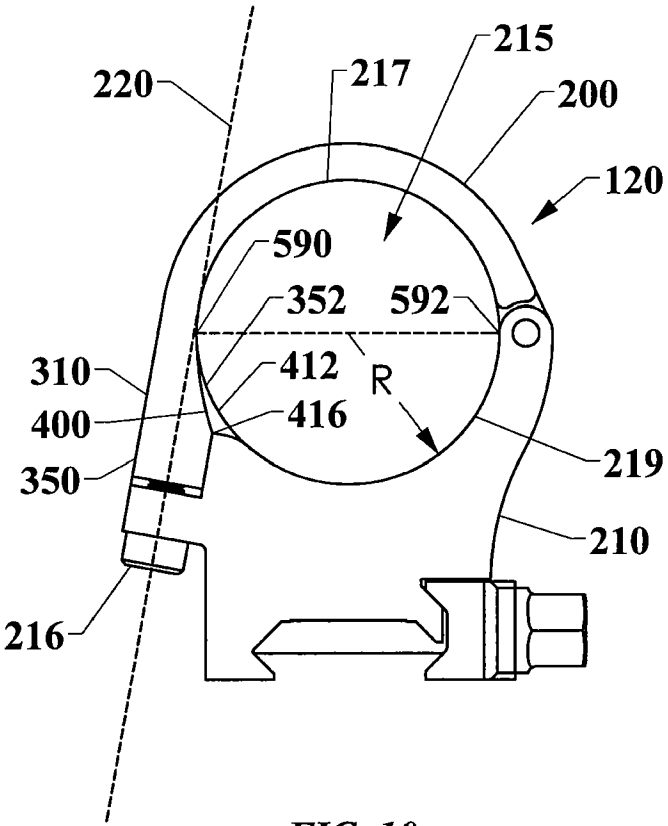
FIG. 10 is a front elevational view of the mounting clamp of FIG. 9 in a closed configuration.

FIG. 10 shows the opening 215 with a generally circular shape. In other embodiments, the opening 215 can have other shapes based on the cross-sectional shape of the scope 110. The inner surface 217 of the ring cap 200 and the inner surface 219 of the ring base 210 can provide about 360 degrees of contact. Such a high level of contact allows for relatively high uniform clamping forces. The surfaces 217, 219 can also provide gradual transitions between features to mitigate stress concentrations in the scope.

FIG. 10 also shows a portion 400 of the surface 217 extending alongside the protrusion 352. The radius of curvature of the inner surface 412 of the protrusion 352 can be smaller than the radius of curvature of the portion 400 of surface 217. A corner 416 of the end 310 remains spaced apart from the scope 110 as the clamp 120 is tightened. Thus, contact is maintained only with curved surfaces of the clamp 120 when the clamp 120 is closed.

Figure 12:
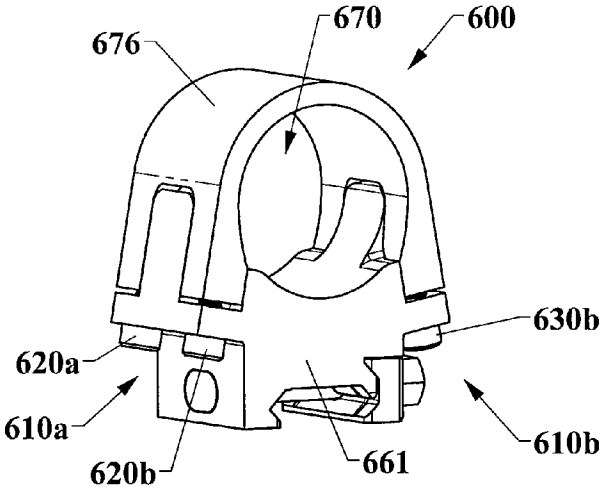
FIGS. 11 and 12 are isometric views of a mounting clamp, in accordance with one embodiment.
Figure 11:
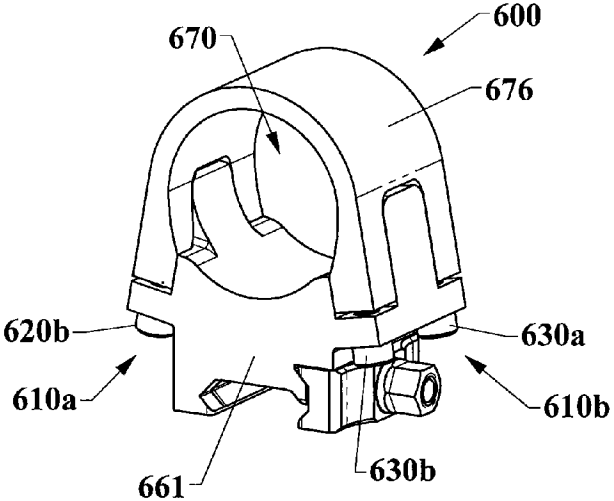
Figure 13:
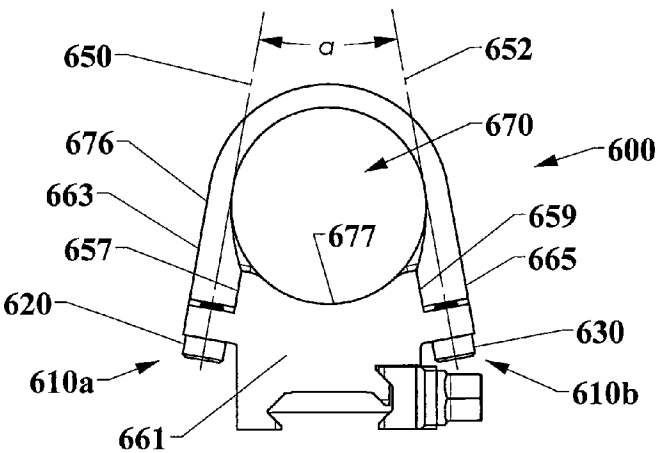
FIG. 13 is a front elevational view of the mounting clamp of FIGS. 11 and 12.

In another embodiment, as shown in FIGS. 11-13, a mounting clamp 600 includes two closing devices 610*a*, 610*b* (collectively "610"). The closing device 610*a* includes a pair of fasteners 620*a*, 620*b* (collectively "620"), and the closing device 610*b* includes a pair of fasteners 630*a*, 630*b* (collectively "630"). Lines of action 650 of the fasteners 620, and lines of action 652 of the fasteners 630 are generally tangent to an opening 670. Both lines of action 650, 652 provide generally tangential loading. The illustrated lines of action 650 and the lines of action 652 define an angle $\alpha$ in a range of about 10 degrees to about 30 degrees. Other angles are also possible, if needed or desired. Walls 657, 659 (FIG. 13) of a ring base 661 can prevent movement of ends 663, 665 towards one another, thereby maintaining the shape of a ring cap 676.

To mount a scope, a ring cap 676 can be separated from the ring base 661. After placing the scope on the ring base 661, the ring cap 676 can be mated with the ring base 661. The fasteners 620, 630 are inserted through corresponding holes in the ring base 661 and holes in the ring cap 676. The ends 663, 665 may be moved away from a central portion 677 due to laterally outward expansion of the scope when the scope is compressed. The central portion 677 of the ring base 661 can prevent the inward displacement of ends 663, 665 of the ring cap 676 as the mounting clamp 600 is closed.

Figure 15:
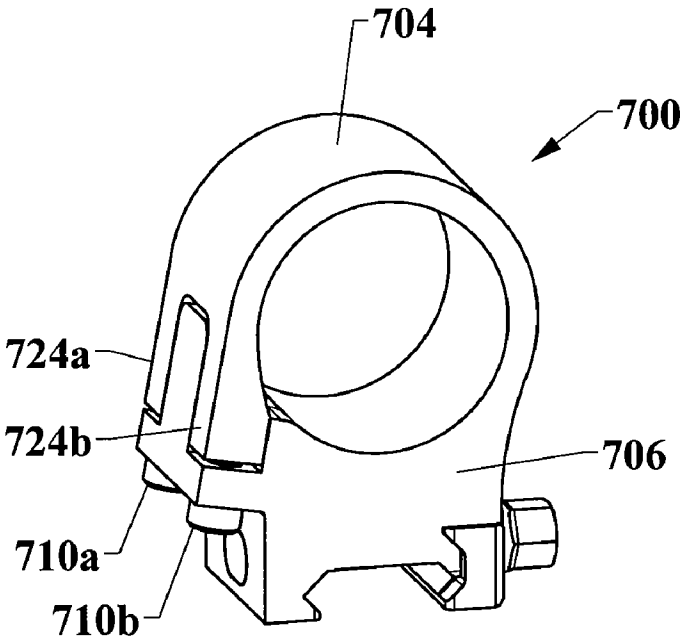
FIG. 15 is an isometric view of the mounting clamp of FIG. 14 in a closed position.
Figure 14:
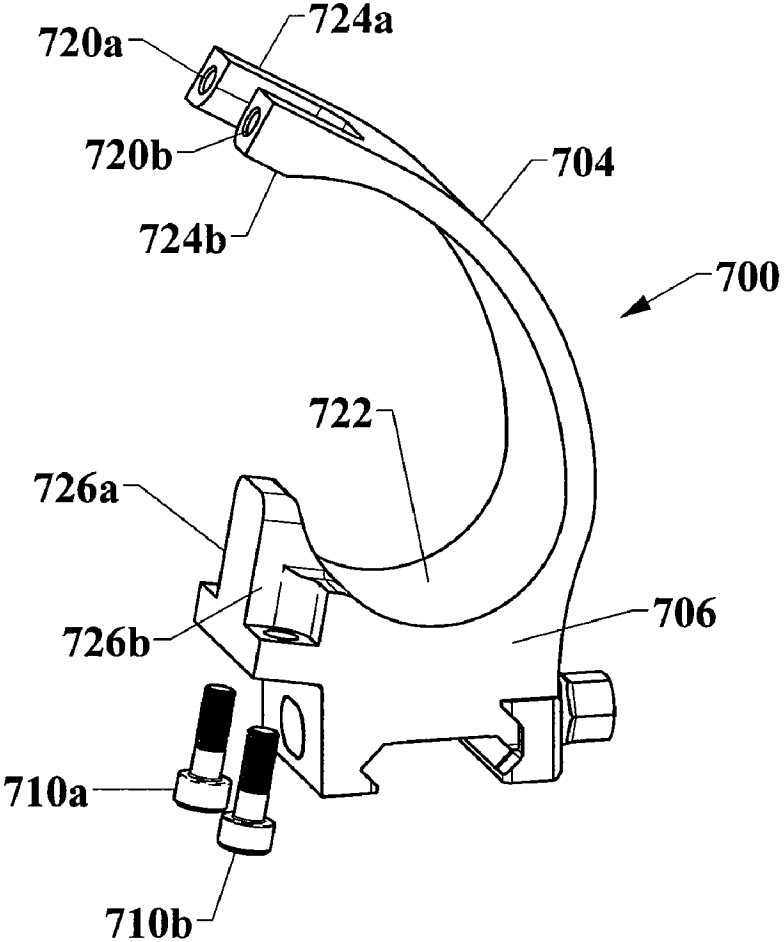
FIG. 14 is an isometric view of a mounting clamp in an open position, in accordance with one embodiment. Fasteners are shown ready to be installed.

Mounting clamps can also have one-piece constructions. FIGS. 14 and 15 show a mounting clamp 700 including a ring cap 704 and a ring base 706 integrally formed with one another. The ring cap 704 is sufficiently flexible to move from an open position (see FIG. 14) to a closed position (see FIG. 15). Fasteners 710*a*, 710*b* (collectively "710") can be used to close the mounting clamp 700.

A scope can be conveniently placed in the mounting clamp 700 in the open position. The ring cap 704 can be wrapped around the scope resting on a lower surface 722 of the ring body 706. Legs 724*a*, 724*b* can be placed in cutouts 726*a*, 726*b*, respectively. The fasteners 710*a*, 710*b* can be inserted into the metal inserts 720*a*, 720*b*, respectively. The fasteners 710 can then be torqued until the clamp 700 is tightened as desired.

A wide range of different materials can be used to make the mounting clamp 700. In some embodiments, the ring cap 704 and the ring base 706 are made, in whole or in part, of a compliant material that is formed via an injection molding process. To increase pullout strengths, the ring cap 704 can include metal inserts 720*a*, 720*b* that threadably mate with the fasteners 710*a*, 710*b*, respectively. Advantageously, the flexible mounting clamp 700 can assume a different shape for use with different scopes while providing high clamping forces.

Unless the context requires otherwise, throughout the specification and claims which follow, the word "comprise" and variations thereof, such as "comprises" and "comprising," are to be construed in an open, inclusive sense, that is as "including, but not limited to."

It should be noted that, as used in this specification and the appended claims, the singular forms "a," "an," and "the" include plural referents unless the context clearly dictates otherwise. For example, "a fastener" includes a single fastener and/or a plurality of fasteners. It should also be noted that the term "or" is generally employed in its sense including "and/or" unless the context clearly dictates otherwise.

Various methods and techniques described above provide a number of ways to carry out the invention. There is interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein, such as methods of installation and assembly, are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A scope mounting clamp coupleable to a firearm, comprising:

a ring cap;

a ring base configured to cooperate with the ring cap to define an opening for receiving a scope; and a fastener connectable to both the ring cap and the ring base, the fastener being configured to provide a closing force to close the scope mounting clamp when the fastener is rotated about a longitudinal axis of the fastener, the longitudinal axis of the fastener is tangent to the opening when the scope mounting clamp is in a closed configuration, the entire fastener is positioned on one side of a plane that is substantially perpendicular to the longitudinal axis of the fastener and laying upon a longitudinal axis of the opening.

2. The scope mounting clamp of claim 1, wherein a minimum distance from the opening to the longitudinal axis of the fastener is less than half a major diameter of a threaded portion of the fastener.

3. A scope mounting clamp coupleable to a firearm, comprising:

a first part;

a second part movable from an open position to a closed position, the second part including a first end, a second end, and a main body extending between the first end and the second end to form a curved contact surface for contacting and holding a scope; and a fastener having a longitudinal axis and configured to engage a portion of the first part and to engage the first end such that the longitudinal axis of the fastener is substantially tangent to the curved contact surface when the fastener is tightened by rotating the fastener about the longitudinal axis.

4. The scope mounting clamp of claim 3, wherein a closing force along a line of action provided by the fastener is proximate to an opening defined by the first part and the second part to substantially prevent radially inward deformation of at least one of the first part and the second part.

5. The scope mounting clamp of claim 3, wherein a minimum distance from an opening for receiving a scope to the longitudinal axis of the fastener is less than half a major diameter of a threaded portion of the fastener.

6. The scope mounting clamp of claim 3, wherein the first part includes a protrusion between a pair of spaced apart legs of the second part when the second part is in the closed position.

7. The scope mounting clamp of claim 3, wherein the first part is rotatably coupled to the second part.

8. A mounting clamp for a firearm, comprising;

a first part;

a second part, at least a portion of the first part and at least a portion of the second part cooperate to form an opening; and at least one elongate fastener positioned to engage the first part and the second part to provide a force along a longitudinal axis of the at least one elongate fastener to tighten the scope mounting clamp, the at least one elongate fastener being spaced apart from a plane that is lying upon a longitudinal axis of the opening and being substantially perpendicular to the longitudinal axis of the at least one elongate fastener, the fastener is rotatable about the longitudinal axis which is substantially tangent to the opening.

9. The mounting clamp of claim 8, wherein the at least one elongate fastener is between the plane and the firearm when the first part is coupled to a firearm.

10. The mounting clamp of claim 8, wherein the at least one elongate fastener is positioned with respect to the opening such that a minimum distance between the longitudinal axis of the at least one elongate fastener and the opening is less than about half of a major diameter of a threaded portion of the fastener.

11. A mounting clamp, comprising:

a ring assembly mountable to a firearm and including a ring cap and a ring base; and a closing device configured to move the ring cap towards the ring base while maintaining a distance of separation between diametrically opposed portions of at least one of the ring cap and the ring base, the closing device including a fastener connectable to both the ring cap and the ring base, the fastener has a longitudinal axis and is configured to provide a closing force to close the mounting clamp when rotated about the longitudinal axis of the fastener, the longitudinal axis of the fastener is tangent to a scope-receiving opening defined by the ring cap and the ring base when the mounting clamp is holding the scope.

12. The mounting clamp of claim 11, wherein the closing device is configured to impart a closing force that is substantially tangent to an outer surface of a scope held by the ring assembly.

13. The mounting clamp of claim 11, wherein the closing force is positioned with respect to an opening of the ring assembly to provide a minimum distance between a line of action of the closing force and the opening, the minimum distance is sufficiently small to substantially prevent at least one of the ring cap and ring base from deforming radially inward as the ring assembly is tightened about a scope.

14. The mounting clamp of claim 11, wherein the closing device includes at least two fasteners that engage bosses of the ring base and engage the ring cap towards a periphery of the opening.

15. The mounting clamp of claim 11, wherein the fastener is a threaded fastener that couples the ring cap to the ring base, the at least one threaded fastener is spaced apart from a plane, the plane lying upon a longitudinal axis of a passage of the ring assembly and is substantially perpendicular to a line of action of a closing force provided by the threaded fastener when the closing device tightens the mounting clamp.

* * * * *

UNITED STATES PATENT AND TRADEMARK OFFICE

CERTIFICATE OF CORRECTION

PATENT NO. : 8,171,666 B2
APPLICATION NO. : 12/510973
DATED : May 8, 2012
INVENTOR(S) : Karagias It is certified that error appears in the above-identified patent and that said Letters Patent is hereby corrected as shown below:

In the specification

Column 7, line 52, delete “35% A” and insert -- 35% --, therefor.

In the claims

Column 10, line 32, claim 8, delete “comprising;” and insert -- comprising: --, therefor.

Signed and Sealed this
Ninth Day of February, 2016

Michelle K. Lee

Michelle K. Lee
*Director of the United States Patent and Trademark Office*